US005607527A

United States Patent [19]

Isley, Jr.

[11] Patent Number: 5,607,527

[45] Date of Patent: Mar. 4, 1997

[54] METHOD OF MAKING FABRIC REINFORCED CONCRETE COLUMNS TO PROVIDE EARTHQUAKE PROTECTION

[75] Inventor: Frederick P. Isley, Jr., Tracy, Calif.

[73] Assignee: Hexcel Corporation, Dublin, Calif.

[21] Appl. No.: 305,735

[22] Filed: Sep. 14, 1994

Related U.S. Application Data

[60] Continuation of Ser. No. 35,732, Mar. 23, 1993, abandoned, which is a division of Ser. No. 842,006, Feb. 25, 1992, Pat. No. 5,218,810.

[51] Int. Cl.[6] ..... E04H 9/02; E04H 9/00

[52] U.S. Cl. ..... 156/71; 156/94; 156/98; 156/172; 264/36

[58] Field of Search ..... 156/71, 94, 172, 156/98, 188; 52/746, 514, 742, 167.1, 167.6; 405/216; 264/36; 29/402.18

[56] References Cited

U.S. PATENT DOCUMENTS

| | | | |
|---|---|---|---|
| 3,304,115 | 9/1967 | Rubenstein | 156/172 X |
| 4,786,341 | 11/1988 | Kobatake et al. | 156/71 |
| 4,918,883 | 4/1990 | Owen et al. | 405/216 X |
| 5,043,033 | 8/1991 | Fyfe | 156/71 |
| 5,254,387 | 10/1993 | Gallucci . | |

FOREIGN PATENT DOCUMENTS

| | | | |
|---|---|---|---|
| 0002267 | 6/1979 | European Pat. Off. . | |
| 0378232 | 7/1990 | European Pat. Off. . | |
| 0427873 | 5/1991 | European Pat. Off. . | |
| 2822519 | 11/1979 | Germany | 264/137 |
| 243467 | 2/1990 | Japan | 156/172 |
| 3212568 | 9/1991 | Japan | 156/71 |
| 462921 | 5/1975 | U.S.S.R. | 242/7.21 |

OTHER PUBLICATIONS

Seminar Sponsored by Japan Architecture Association in Japan, Sep. 1987, pp. 1749–1750.

Leonard, LaVerne, "Rebuilding the infrastructure with advanced composites", *Advanced Composites,* May/Jun. 1990, pp. 43–47.

*Primary Examiner*—Jeff H. Aftergut
*Attorney, Agent, or Firm*—Poms, Smith, Lande & Rose

[57] ABSTRACT

Reinforced concrete columns wherein the exterior surface of the concrete column is wrapped with a composite reinforcement layer. The composite reinforcement layer includes at least one fabric layer which is located within a resin matrix. The fabric layer has first and second parallel selvedges which extend around the circumferential outer surface of the column in a direction substantially perpendicular to the column axis. Specific weave patterns are disclosed. The composite reinforcement layer provides a quick, simple and effective means for increasing the resistance of concrete columns to failure during the application of asymmetric loads.

11 Claims, 3 Drawing Sheets

METHOD OF MAKING FABRIC REINFORCED CONCRETE COLUMNS TO PROVIDE EARTHQUAKE PROTECTION

RELATED PATENT APPLICATIONS

This application is a continuation of U.S. patent application, Ser. No. 08/035,732, filed Mar. 23, 1993, now abandoned, which is a division of Ser. No. 07/842,006 filed Feb. 25, 1992, now U.S. Pat. No. 5,218,810.

BACKGROUND OF THE INVENTION

1. Field of the Invention

The present invention relates generally to reinforcing concrete columns to increase their ability to withstand asymmetric loading. More particularly, the present invention involves reinforcing the exterior surface of the concrete column to increase the ability of the concrete column to withstand asymmetric loading during earthquakes.

2. Description of Related Art

Concrete columns are widely used as support structures. Bridge supports, freeway overpass supports, building structural supports and parking structure supports are just a few of the many uses for concrete columns. Concrete columns exist in a wide variety of shapes. Concrete columns with circular, square and rectangular cross-sections are most common. However, numerous other cross-sectional shapes have been used including regular polygonal shapes and irregular cross-sections. The size of concrete columns also varies greatly depending upon the intended use. Concrete columns with diameters on the order of 2 to 20 feet and lengths of well over 50 feet are commonly used as bridge or overpass supports.

It is common practice to reinforce concrete columns with metal rods or bars. The metal reinforcement provides a great deal of added structural strength to the concrete column. Although metal reinforcement of concrete columns provides adequate structural reinforcement under most circumstances, there have been numerous incidents of structural failure of metal-reinforced concrete columns when subjected to asymmetric loads generated during earthquakes. The structural failure of a metal reinforced concrete support column during an earthquake can have disastrous consequences. Accordingly, there is a continuing need to enhance the ability of concrete columns to withstand the asymmetric loads which are applied to the column during an earthquake.

One way of increasing the structural integrity of concrete columns is to include additional metal reinforcement prior to pouring the concrete column. Other design features may be incorporated into the concrete column fabrication in order to increase its resistance to asymmetric loading. However, there are hundreds of thousands of existing concrete supports located in earthquake prone areas which do not have adequate metal reinforcement or structural design to withstand high degrees of asymmetric loading. Accordingly, there is a need to provide a simple, efficient and relatively inexpensive system for reinforcing such existing concrete columns to prevent or reduce the likelihood of failure during an earthquake.

One example of a method for increasing the structural strength of existing concrete structures is set forth in U.S. Pat. No. 4,786,341. In this particular patent, the outer surface of the concrete column is reinforced by wrapping a fiber around the column in a variety of different patterns. A problem with this particular method is the amount of time required to wrap a concrete column with a single fiber is time consuming and expensive.

Another approach to reinforcing the exterior of an existing concrete support column is set forth in U.S. Pat. No. 5,043,033. In this patent, the exterior of the concrete column is wrapped with a composite material to form a shell surrounding the concrete column. The space between the outer composite shell and the concrete column is then pressurized by injecting a hardenable liquid.

Although the above approaches to reinforcing existing concrete columns may be well-suited for their intended purpose, there is still a need to provide a fast, efficient, simple and cost effective way to adequately reinforce a variety of concrete columns to increase their resistance to structural failure during an earthquake.

SUMMARY OF THE INVENTION

In accordance with the present invention, a simple, efficient and cost effective process is provided for reinforcing the exterior surface of concrete columns to increase the column's resistance to structural failure when subjected to asymmetric loading. The present invention is based upon the recognition that the resistance of concrete columns to structural failure can be increased by wrapping the outer surface of the concrete column with a composite reinforcement layer which is made up of at least one fabric layer and an associated resin matrix.

As a feature of the present invention, the composite reinforcement layer is wrapped around the exterior surface of the concrete column so that it is in direct contact with the surface. The fabric layer within the composite reinforcement layer has first and second parallel selvedges which extend circumferentially around the concrete column in a direction which is substantially perpendicular to the axis of the concrete column. The composite reinforcement layers may be wrapped around the concrete at strategic structural locations or, preferably, the entire concrete column exterior surface is wrapped with the composite reinforcement layer. The wrapping of the concrete column with the composite reinforcement layer in accordance with the present invention is a simple, quick, efficient and cost effective way to reinforce existing concrete columns to reduce the likelihood of failure in the event of an earthquake.

As another feature of the present invention, the fabric layer located within the resin matrix includes a plurality of warp yarns which extend substantially parallel to the selvedges and a plurality of fill yarns which extend substantially parallel to the axis of the concrete column. Alternatively, the fabric layer may comprise a plurality of plus bias angle yarns which extend at an angle of between about −20 to −70 degrees relative the selvedges and a plurality of minus bias angle yarns which extend at an angle of between about −20 to −70 degrees relative the selvedge.

In addition to the actual reinforced concrete column, the present invention also involves the method for reinforcing the column. The method includes the steps of providing a fabric layer having first and second selvedges extending parallel to each other. The fabric layer is impregnated with a curable resin to form a resin impregnated fabric layer. After resin impregnation, the fabric layer is applied directly to the circumferential outer surface of the concrete column to provide a composite reinforcement layer wherein the selvedges of the fabric extend around the outer column surface substantially perpendicular to the axis of the column. After application, the composite reinforcement layer is cured to form the final composite reinforcement layer.

The above discussed and many other features and attendant advantages of the present invention will become better understood by reference to the following detailed description when taken in conjunction with the accompanying drawings.

DETAILED DESCRIPTION OF THE INVENTION

The present invention may be used to reinforce a wide variety of concrete support columns. The invention is especially well-suited for reinforcing relatively large metal-reinforced concrete columns of the type used to support bridges and freeway overpasses. Such concrete columns are typically reinforced with a metal infrastructure and have diameters or cross-sectional widths of up to 20 feet or more. The length of the columns also range from a few feet to well over 50 feet. The following detailed description will be limited to describing use of the present invention to reinforce a circular concrete column used to support a freeway overpass. It will be understood by those skilled in the art that the present invention is not limited to such circular concrete columns, but also may be applied to concrete columns of any size and any cross-sectional shape.

Figure 1:
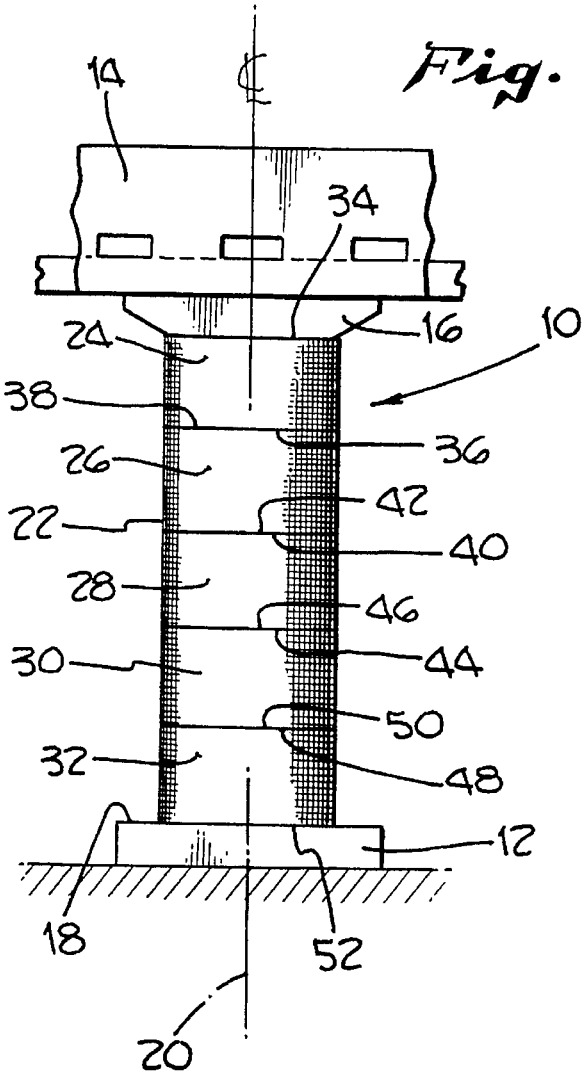
FIG. 1 is an elevational view showing an exemplary preferred reinforced concrete column in accordance with the present invention.

A preferred exemplary reinforced concrete column in accordance with the present invention is shown generally at 10 in FIG. 1. The reinforced concrete column 10 is supported by a suitable base 12 and is supporting a freeway overpass 14. The concrete column is a typical freeway overpass support structure having a circular cross-section with a diameter of between 5 to 15 feet. The height of the concrete column is approximately 16 feet. The concrete column has a top 16, a bottom 18, a longitudinal axis represented by dotted arrow 20 and a circumferential outer surface 60 (See FIG. 3).

The reinforced concrete column 10 includes a composite reinforcement layer 22. The composite reinforcement layer 22 is in direct contact with the circumferential outer surface 60 of the concrete column. The composite reinforcement layer 22 is made up of four fabric layers 24, 26, 28, 30 and 32. Each of the fabric layers 24–32 have first and second parallel selvedges. The first and second selvedges for fabric layer 24 are shown at 34 and 36, respectively. The first and second selvedges for fabric layer 26 are shown at 38 and 40, respectively. The first and second selvedges for fabric layer 28 are shown at 42 and 44, respectively. The first and second selvedges for fabric layer 30 are shown at 46 and 48, respectively. The first and second selvedges for fabric layer 32 are shown at 50 and 52, respectively.

It is preferred that the fabric layers 24–32 be placed on the exterior surface of the concrete column so that substantially the entire surface is covered. However, in certain applications, it may be desirable to only wrap those portions of the concrete column which are most likely to fail during asymmetric loading. The fabric layers 24–32 may include a single fabric layer or they may be laminates made up of two or more layers of fabric wrapped circumferentially around the concrete column. In accordance with the present invention, the first and second parallel selvedges 34–52 extend around the circumferential outer surface of the concrete column in a direction which is substantially perpendicular to the axis 20 of the concrete column. The fabric layers are all resin impregnated prior to application so that the final fabric layers are located within a resin matrix. The width of the fabric between the selvedges may be from 3 to 100 inches.

Figure 3:
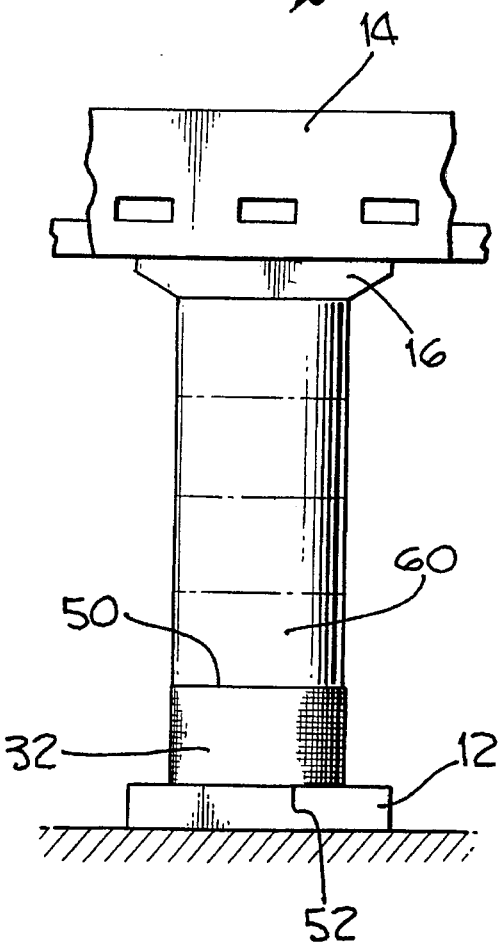
FIG. 3 is an elevational view of a partially wrapped concrete column.
Figure 2:
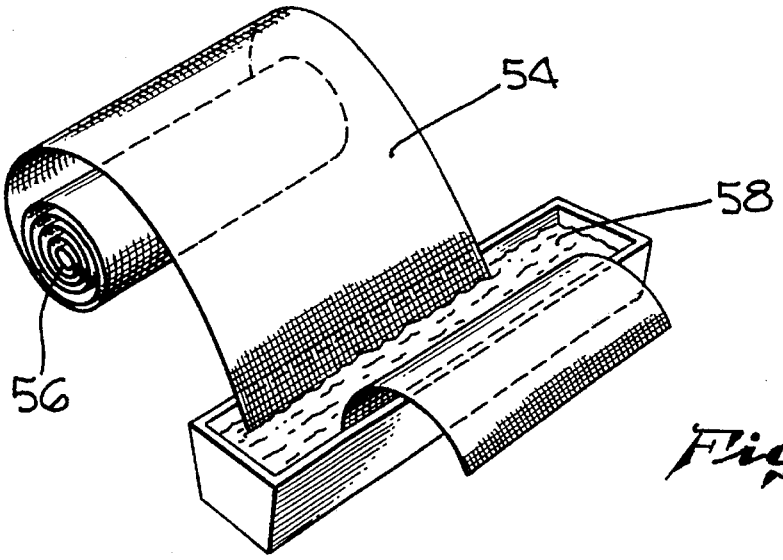
FIG. 2 is a demonstrative representation depicting impregnation of the fabric layer prior to application to the outer surface of the concrete column.

Referring to FIG. 2, a fabric 54 is shown being unwound from roll 56 and dipped in resin 58 for impregnation prior to application to the concrete column. Once a sufficient length of fabric 54 has been impregnated with resin 58 and made wet, the impregnated fabric layer is cut from roll 56 and is applied to the exterior surface 60 of the concrete column in a wet state as shown in FIG. 3. The length of impregnated fabric is chosen to provide either one wrapping or multiple wrappings of the concrete column. Once in place, the resin impregnated fabric layer is allowed to cure to form the composite reinforcement layer. The impregnation and application process shown in FIGS. 2 and 3 is repeated until the entire outer circumferential surface of the concrete column has been covered as shown in FIG. 1.

Figure 4:
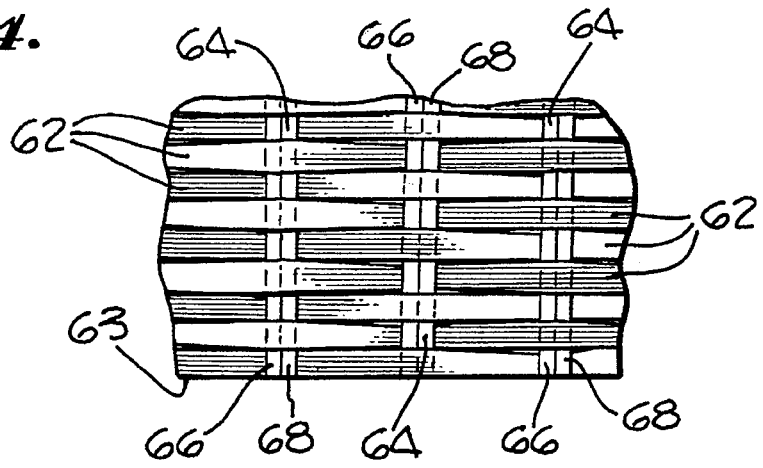
FIG. 4 is a detailed partial view of a preferred exemplary fabric layer in accordance with the present invention.

A preferred exemplary fabric is shown in FIG. 4. The fabric is preferably a plain woven fabric having warp yarns 62 and fill yarns 64. The warp yarns and fill yarns may be made from the same fibers or they may be different. Preferred fibers include those made from glass, polyaramid, graphite, silica, quartz, carbon, ceramic and polyethylene. The warp yarns 62 are preferably made from glass. The fill yarns 64 are preferably a combination of glass fibers 66 and polyaramid fibers 68. The diameters of the glass and polyaramid fibers preferably range from about 3 microns to about 30 microns. It is preferred that each glass yarn include between about 200 to 8,000 fibers. The fabric is preferably a plain woven fabric, but may also be a 2 to 8 harness satin weave. The number of warp yarns per inch is preferably between about 5 to 20. The preferred number of fill yarns per inch is preferably between about 0.5 and 5.0. The warp yarns extend substantially parallel to the selvedge 63 with the fill yarns extending substantially perpendicular to the selvedge 63 and substantially parallel to the axis of the concrete column. This particular fabric weave configuration provides reinforcement in both longitudinal and axial directions. This configuration is believed to be effective in reinforcing the concrete column against asymmetric loads experience by the column during an earthquake.

Figure 5:
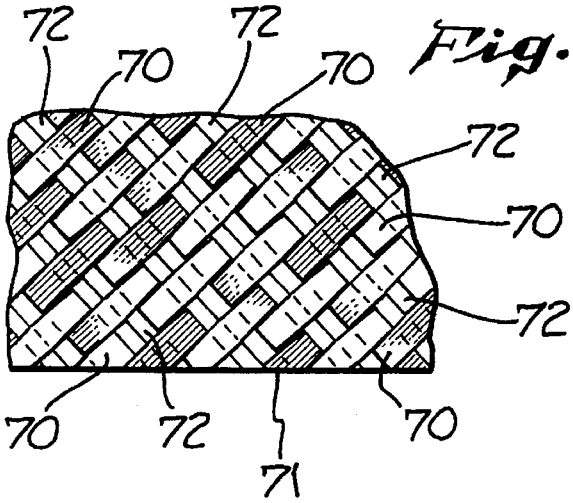
FIG. 5 is a detailed partial view of an alternate exemplary preferred fabric layer in accordance with the present invention.

A preferred alternate fabric pattern is shown in FIG. 5. In this fabric pattern, plus bias angle yarns 70 extend at an angle of between about 20 to 70 degrees relative to the selvedge 71 of the fabric. The preferred angle is 45 degrees relative to the selvedge 71. The plus bias angle yarns 70 are preferably made from yarn material the same described in connection with the fabric shown in FIG. 4. Minus bias angle yarns 72 extend at an angle of between about −20 to −70 degrees relative to the selvedge 71. The minus bias angle yarns 72 are preferably substantially perpendicular to the plus bias angle yarns 70. The bias yarns 70 and 72 are preferably composed of the same yarn material. The number of yarns per inch for both the plus and minus bias angle is preferably between about 5 and 30 with about 10 yarns per inch being particularly preferred.

Figure 6:
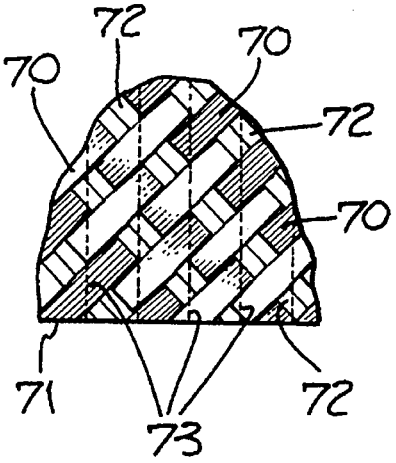
FIG. 6 depicts a weave pattern which is the same as the weave pattern shown in FIG. 5 except that the yarns are stitch bonded together.

It is preferred that the fabric weave patterns be held securely in place relative to each other. This is preferably accomplished by stitch bonding the yarns together as shown in FIG. 6. An alternate method of holding the yarns in place is by the use of adhesive or leno weaving processes, both of which are well known to those skilled in the art. In FIG. 6, exemplary yarns used to provide the stitch bonding are shown in phantom at 73. The process by which the yarns are stitch bonded together is conventional and will not be described in detail. The smaller yarns used to provide the stitch bonding may be made from the same materials as the principal yarns or from any other suitable material commonly used to stitch bond fabric yarns together. The fabric shown in FIG. 4 may be stitch bonded.

Figure 9:
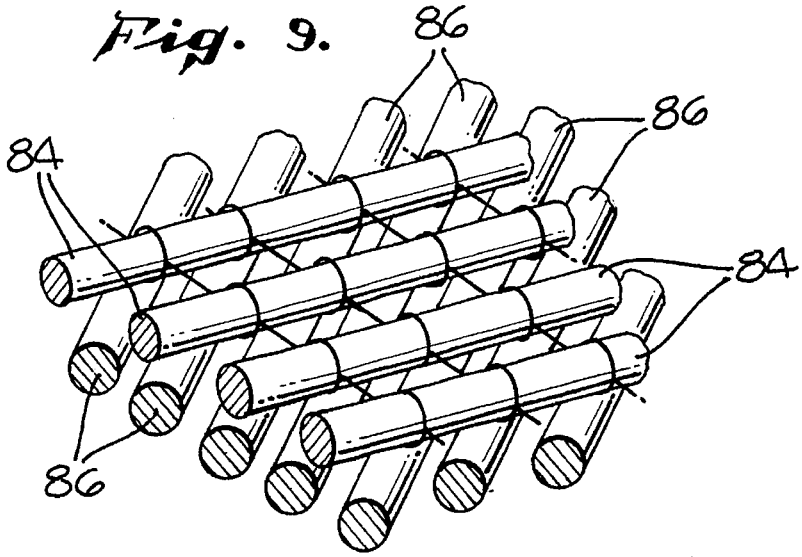
FIG. 9 depicts the unidirectional stitch bonded fabric of FIG. 8 in combination with a second layer of diagonally oriented unidirectional fabric.

Also, if desired, unidirectional fabric which is stitch bonded may be used in accordance with the present invention. Such a unidirectional stitch bonded fabric is shown in FIG. 9 at 79. The fabric includes unidirectional fibers 80 which are stitch bonded together as represented by lines 82. The unidirectional stitch bonded fabric 79 may be used alone or in combination with other fabric configurations. For example, a two layer fabric system is shown in FIG. 9 where an upper unidirectional stitch bonded layer 84, which is the same as the fabric layer 79, is combined with a diagonally oriented lower layer of unidirectional fibers 86. The lower fabric layer may or may not be stitch bonded. The fabric layer 86 shown in FIG. 9 is not stitch bonded.

Figure 10:
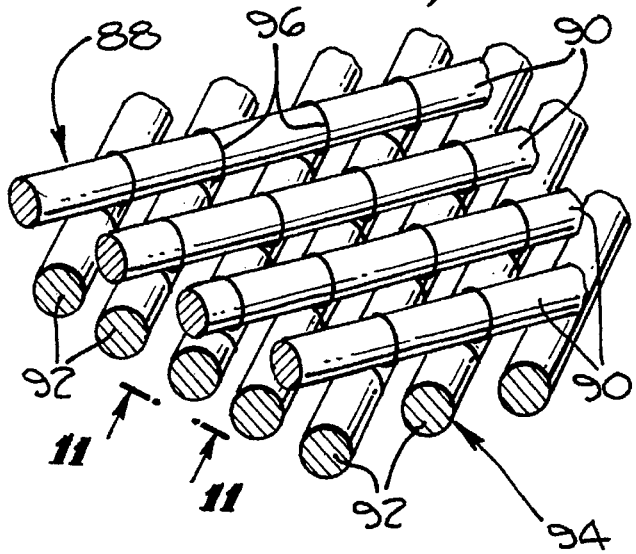
FIG. 10 depicts an alternate fabric layer arrangement wherein two diagonally oriented unidirectional fabrics are stitch bonded together.
Figure 11:
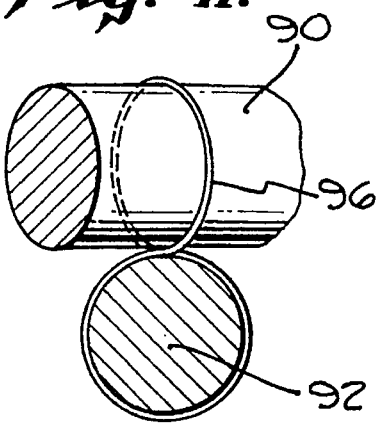
FIG. 11 is a sectional view of FIG. 10 taken in the 11—11 plane.

Another alternate fabric layer embodiment is shown in FIGS. 10 and 11. In this embodiment, the upper layer 88 is a unidirectional fabric in which the fibers 90 are not stitch bonded together. Instead, the fibers 90 are stitch bonded to the fibers 92 of the lower layer 94 as represented by lines 96.

Figure 7:
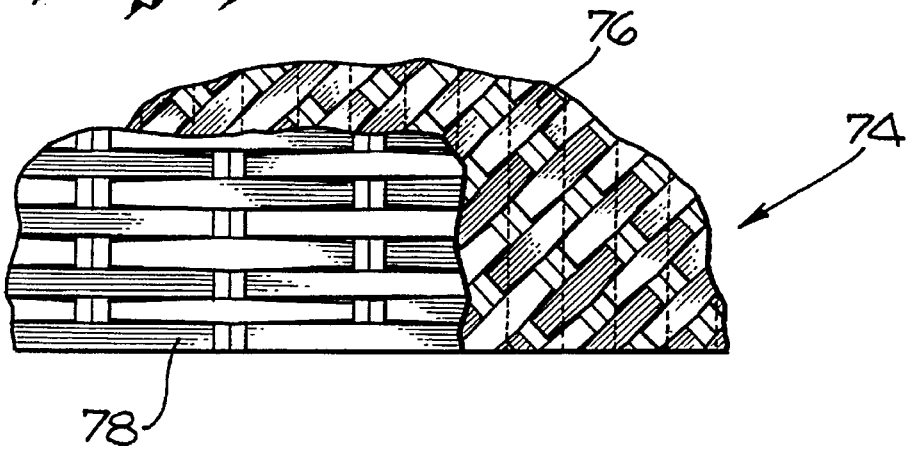
FIG. 7 is a detailed partial view of the outer surface of a concrete column which has been wrapped with multiple fabric layers.
Figure 8:
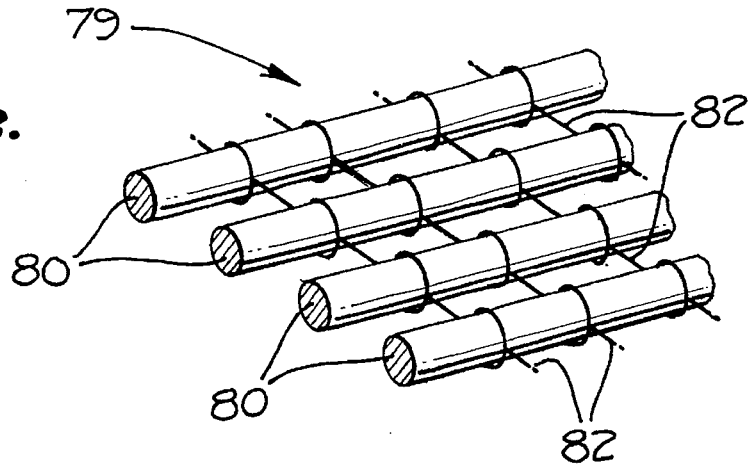
FIG. 8 depicts unidirectional fabric which is stitch bonded and may be used as a fabric layer in accordance with the present invention.

In FIG. 7, a portion of a composite reinforcement layer surrounding a concrete column is shown generally at 74. The composite reinforcement layer 74 includes an interior fabric layer 76 which is the same as the fabric layer shown in FIG. 6. In addition, an exterior fabric layer 78 is provided which is the same as the fabric layer shown in FIG. 4. This dual fabric layer composite reinforcement provides added structural strength when desired.

All of the fabric layers must be impregnated with a resin in order to function properly in accordance with the present invention. Preferably, the resin is impregnated into the fabric prior to application to the concrete column exterior surface. However, if desired, the resin may be impregnated into the fabric after the fabric is wrapped around the concrete column. Suitable resins for use in accordance with the present invention include polyester, epoxy, polyamide, bismaleimide, vinylester, urethanes and polyurea. Other impregnating resins may be utilized provided that they have the same degree of strength and toughness provided by the previously listed resins. Epoxy based resin systems are preferred.

Curing of the resins is carried out in accordance with well known procedures which will vary depending upon the particular resin matrix used. The various conventional catalysts, curing agents and additives which are typically employed with such resin systems may be used. The amount of resin which is impregnated into the fabric is preferably sufficient to saturate the fabric.

It is preferred that the concrete column exterior surface be thoroughly cleaned prior to application of the impregnated fabric layers. The concrete column should be sufficiently cleaned so that the resin matrix will adhere to the concrete material. Although bonding of the resin matrix and composite reinforcement layer to the concrete is preferred, it is not essential. Bonding of the resin matrix to the concrete column is desirable, but not necessary since it increases the structural reinforcement capabilities of the impregnated fabric.

Having thus described exemplary embodiments of the present invention, it should be understood by those skilled in the art that the within disclosures are exemplary only and that various other alternatives, adaptations and modifications may be made within the scope of the present invention. Accordingly, the present invention is not limited to the specific embodiments as illustrated herein, but is only limited by the following claims.

What is claimed is:

1. A method for reinforcing a concrete column which supports a bridge or other structure to increase the ability of the column to withstand asymmetric loading during an earthquake wherein said column has a top attached to said bridge or other structure, a bottom, a vertical axis, and a circumferential outer surface extending axially between said column top and bottom, said method comprising the steps of:

providing a fabric layer having first and second selvedges extending parallel to each other, said fabric layer comprising a plurality of interwoven fibers;

impregnating said fabric layer with a curable resin to form a wet resin impregnated fabric layer in a wet state;

the method further comprising the steps in the order named:

applying said wet resin impregnated fabric layer in said wet state directly to the circumferential outer surface of said column to provide a wet composite reinforcement layer which is in direct contact with said circumferential outer surfaces wherein the selvedges of said fabric extend around said outer surface substantially perpendicular to the axis of said column; and allowing said wet resin in said wet composite reinforcement layer to cure to thereby provide a cured composite reinforcement layer which increases the ability of such column to withstand asymmetric loading during an earthquake and thereby continue to provide support for said bridge or other structure.

2. A method for reinforcing a concrete column according to claim 1 wherein said fabric layer comprises a plurality of warp yarns which extend substantially parallel to said selvedges and a plurality of fill yarns which extend substantially parallel to the axis of said concrete column.

3. A method for reinforcing a concrete column according to claim 2 wherein said fabric layer comprises a plurality of plus bias angle yarns which extend at an angle of between about 20 to 70 degrees relative said selvedges and a plurality of minus bias angle yarns which extend at an angle of between about −20 to −70 degrees relative said selvedge.

4. A method for reinforcing a concrete column according to claim 2 wherein said fabric includes about 10 warp yarns per inch and about 2 fill yarns per inch.

5. A method for reinforcing a concrete column according to claim 3 wherein said fabric includes about 10 plus bias angle yarns per inch and about 10 minus bias angle yarns per inch.

6. A method for reinforcing a concrete column according to claim 2 wherein said warp yarns comprise between about 200 to 8000 fibers and said fill yarns comprise between about 200 to 8000 fibers.

7. A method for reinforcing a concrete column according to claim 3 wherein said plus bias angle yarns comprise between about 200 to 8000 fibers and said minus bias angle yarns comprise between about 200 to 8000 fibers.

8. A method for reinforcing a concrete column according to claim 1 wherein said fabric comprises fibers selected from the group consisting of glass, polyaramid, graphite, silica, quartz, carbon, ceramic and polyethylene.

9. A method for reinforcing a concrete column according to claim 1 wherein said resin comprises resin selected from the group consisting of polyester, epoxy, polyamide, bismaleimide, vinylester, urethanes and polyurea.

10. A method for reinforcing a concrete column according to claim 1 wherein said concrete column is wrapped with a plurality of fabric layers.

11. A method for reinforcing a concrete column which supports a bridge or other structure to increase the ability of the column to withstand asymmetric loading during an earthquake wherein said column has a top attached to said bridge or other structure, a bottom, a vertical axis, and a circumferential outer surface extending axially between said column top and bottom, said method comprising the steps of:

providing a wet fabric around the circumferential outer surface of said column, said fabric being impregnated with resin in a wet state, said wet resin impregnated fabric having first and second selvedges extending parallel to each other, said first and second selvedges being substantially perpendicular to said axis of said column;

curing said wet resin to thereby provide a composite reinforcement layer which increases the ability of such column to withstand asymmetric loading during an earthquake and thereby continue to provide support for said bridge or other structure.

* * * * *